US011642282B2

(12) United States Patent
Gobbi Frattini

(10) Patent No.: US 11,642,282 B2
(45) Date of Patent: May 9, 2023

(54) MALE-FEMALE ADAPTER FOR A HERMETICALLY CLOSABLE CONNECTOR WHICH CAN BE BORED BY A MALE FITTING AND AUTOMATICALLY SEALINGLY RECLOSED, PARTICULARLY FOR DEVICES FOR CONTAINING AND DISPENSING LIQUID SOLUTIONS FOR PHARMACOLOGICAL AND/OR NUTRITIONAL USE, AND A MALE FITTING CONNECTOR PROVIDED WITH A MALE-FEMALE ADAPTER

(71) Applicant: PAOLO GOBBI FRATTINI S.R.L., Milan (IT)

(72) Inventor: Paolo Giuseppe Gobbi Frattini, Sondalo (IT)

(73) Assignee: PAOLO GOBBI FRATTINI S.R.L., Milan (IT)

( * ) Notice: Subject to any disclaimer, the term of this patent is extended or adjusted under 35 U.S.C. 154(b) by 887 days.

(21) Appl. No.: 16/592,798

(22) Filed: Oct. 4, 2019

(65) Prior Publication Data

US 2020/0107995 A1 Apr. 9, 2020

(30) Foreign Application Priority Data

Oct. 9, 2018 (IT) ..... 102018000009269

(51) Int. Cl.
*A61J 1/20* (2006.01)

(52) U.S. Cl.
CPC ..... *A61J 1/2048* (2015.05); *A61J 1/2027* (2015.05); *A61J 1/2044* (2015.05); *A61J 1/2096* (2013.01)

(58) Field of Classification Search
CPC ..... A61J 1/1406; A61J 1/1481; A61J 1/2013; A61J 1/2027; A61J 1/2044; A61J 1/2055; A61J 1/2065; A61J 1/2096
See application file for complete search history.

(56) References Cited

U.S. PATENT DOCUMENTS 5,211,638 A * 5/1993 Dudar ..... A61J 1/2089 604/537
8,226,126 B2 * 7/2012 Johns ..... F16L 29/005 285/3

(Continued)

FOREIGN PATENT DOCUMENTS

EP 2 667 839 12/2013
WO 95/15194 A1 6/1995

(Continued)

OTHER PUBLICATIONS

Italian Search Report, dated Jun. 5, 2019 (9 pages).

*Primary Examiner* — Benjamin J Klein
(74) *Attorney, Agent, or Firm* — Jacobson Holman PLLC

(57) ABSTRACT

A male-female adapter (21) can be coupled to a hermetically closable connector (1) with external threading (13) and closing plug (6) which can be bored by pressure of a male fitting so as to form a connector (1)—adapter (21) unit which is suitable for using a female fitting. The adapter (21) comprises an external tubular body (22) with an axial extension (24) which can be hooked to the connector (1) in a rotatable and axially slidable manner, an internal tubular body (26) with terminal tangs (27, 37) axially projecting from the extremities of the external tubular body (22), a middle transversal wall (28) which integrally connects the two tubular bodies (22, 26), and two opposite sense threadings (29, 30) formed in internal portions of the external tubular body (22), which threadings are separated by said middle transversal wall (28).

6 Claims, 4 Drawing Sheets

(56) References Cited

U.S. PATENT DOCUMENTS

| | | | | |
|---|---|---|---|---|
| 8,910,919 | B2 * | 12/2014 | Bonnal | A61M 39/1011 604/533 |
| 2006/0157971 | A1 * | 7/2006 | Baldwin | A61M 39/26 285/3 |
| 2009/0299325 | A1 | 12/2009 | Vedrine et al. | |
| 2014/0311624 | A1 * | 10/2014 | Eilertsen | A61J 1/2096 141/18 |
| 2015/0297462 | A1 * | 10/2015 | Lev | A61J 1/201 604/407 |

FOREIGN PATENT DOCUMENTS

| | | | |
|---|---|---|---|
| WO | 2012/101101 | A1 | 8/2012 |
| WO | 2014/181320 | A1 | 11/2014 |

* cited by examiner

MALE-FEMALE ADAPTER FOR A HERMETICALLY CLOSABLE CONNECTOR WHICH CAN BE BORED BY A MALE FITTING AND AUTOMATICALLY SEALINGLY RECLOSED, PARTICULARLY FOR DEVICES FOR CONTAINING AND DISPENSING LIQUID SOLUTIONS FOR PHARMACOLOGICAL AND/OR NUTRITIONAL USE, AND A MALE FITTING CONNECTOR PROVIDED WITH A MALE-FEMALE ADAPTER

BACKGROUND OF THE INVENTION

The present invention relates to a male-female adapter for a hermetically closable connector which can be bored by means of a male fitting and automatically sealingly reclosed, particularly for devices for containing and dispensing liquid solutions for pharmacological and/or nutritional use, and a male fitting connector provided with a male-female adapter.

In all medical devices intended to contain liquid solutions for pharmacological and/or nutritional use, the connections between the various parts to be connected are very important whatever the purposes such as introducing and collecting liquids, creating circulation circuits, etc.

In particular, bags for containing liquid solutions for pharmacological and/or nutritional use are commonly known from which flexible tubes extend, which are usable for introducing additional substances and/or for collecting the solution contained in the bag.

Such flexible tubes are closed by hermetically sealing connectors which however can be bored for introduction and collection purposes and then be hermetically reclosed once the operation is complete.

Needleless connectors which can be opened are known, for example from US 2008/093571, WO 95/15194 and U.S. Pat. No. 5,268,771, which are provided with a closing plug formed by a deformable plastic body longitudinally crossed by a slit in which a syringe luer or other male fitting can be inserted to cause the temporary opening of a check valve having elastically deformable lips, which is then automatically reclosed when the luer recedes after the introduction or collection operation.

In particular there is known from EP 2 667 839 B1, a connector of the aforesaid type which is provided with the additional feature of a membrane which can be bored and elastically hermetically reclosed which membrane is arranged on the closing plug in one piece therewith to hermetically seal the inlet extremity of said return valve before access with an introduction or collection male fitting, such as the luer of a needleless syringe, and then to hermetically reclose the same after the extraction of the previously introduced male fitting.

Due to such a membrane, the important effect is obtained of ensuring the hermetic sealing of the plug before use and the certainty of the hermetic reclosing of the plug itself after each operation of introducing and extracting the introduction/collection male fitting.

All the aforesaid connectors provided for needleless access have the drawback of only accepting male type boring devices, such as the luer of a syringe or other similar male fitting, while they are currently inaccessible by female fittings.

SUMMARY OF THE INVENTION

It is the object of the present invention to provide a male-female adapter for a hermetically closable connector with a sealing plug which can be bored by inserting a needleless and automatically hermetically reclosable male fitting upon the removal of said male fitting.

It is another object to provide a hermetically closable connector with sealing plug which can be bored and automatically hermetically reclosed, which is suitable for opening and closing by a female fitting.

According to the present invention, such objects are achieved by coupling a hermetically closable connector provided with a sealing plug which can be bored by a male fitting to a male-female adapter which is characterized by comprising an external tubular body with external side wall provided at one extremity with an axial extension which can be hooked to the connector in a rotatable and axially slidable manner, an internal tubular body with terminal tangs axially projecting from respective extremities of said external tubular body, a middle transversal wall which integrally connects a middle portion of said internal tubular body with a corresponding middle portion of said external tubular body and two opposite sense threadings formed in internal portions of said external tubular body which are separated by said middle transversal wall.

By connecting the aforesaid adaptor to any male fitting connector of the aforesaid type, the connector itself may be made suitable for opening by a female fitting with external threading compatible with the internal threading of the portion of adaptor opposite to that which can be hooked to the connector.

DESCRIPTION OF THE DRAWINGS

A male fitting connector provided with a male-female adapter according to the present invention is shown by way of example in the accompanying drawings, in which.

DETAILED DESCRIPTION OF THE INVENTION

Figure 1:
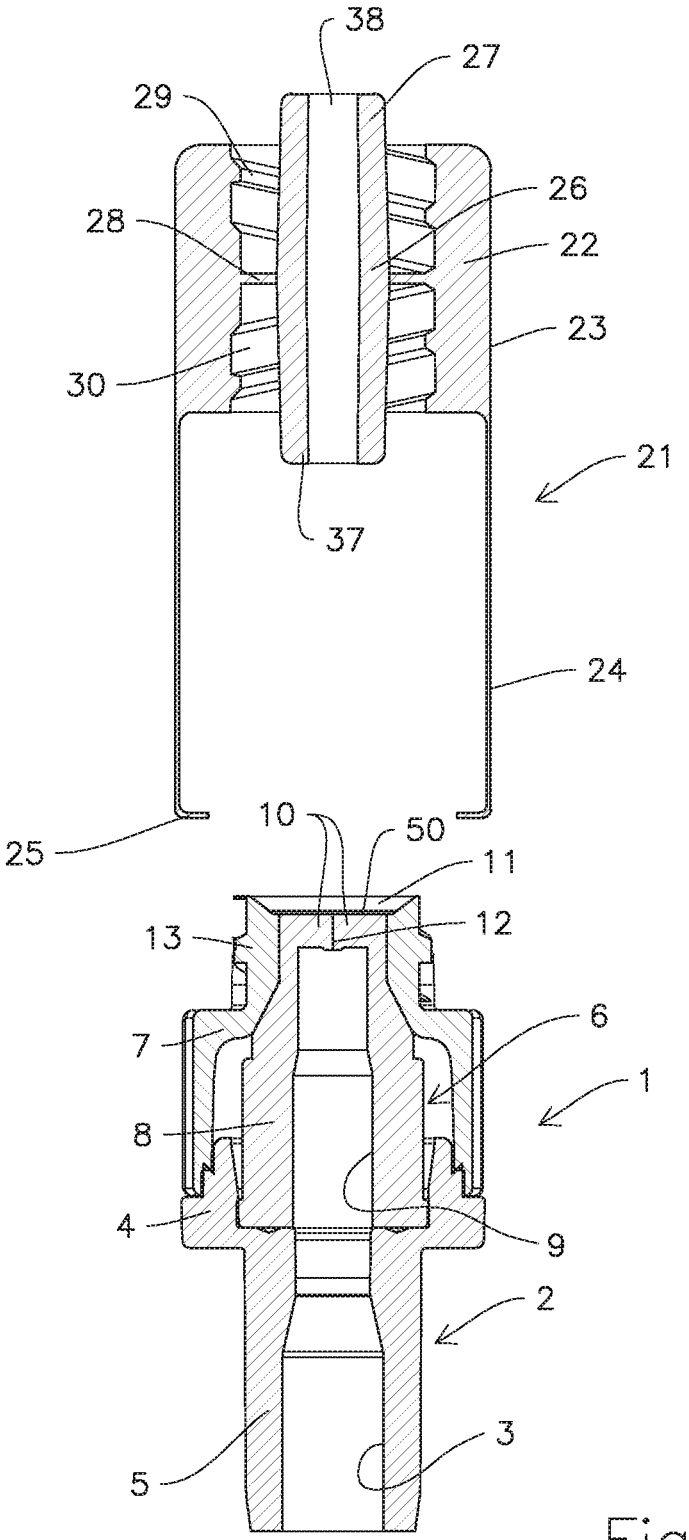
FIG. 1 shows an exploded axial section of the connector and the adapter before the operating coupling thereof.

FIG. 1 shows a connector for a male fitting which is indicated as a whole with numeral 1 and comprises a main body 2 crossed by an axial hole 3. The main body 2 consists of a collar 4 and an axial extension 5.

There is a closing plug 6 in collar 4, overlapping the axial extension 5, the closing plug being made of elastically deformable plastic material and kept in position by an external ring nut 7 with external threading 13 and tapered end mouth 11, which is screwed about collar 4.

The closing plug 6 is provided with a main body 8 with axial hole 9 which ends at the top (looking at FIG. 2) with a pair of elastically flexible lips 10 separated by a narrow axial slit 12 having rectangular section, which ends immediately before the upper extremity of plug 6.

A thin elastic sealing membrane 50 formed in one piece with plug 6 overlaps the two flexible lips 10. The structural and functional features of membrane 50 are those already described in EP 2 667 839 B1, to which explicit descriptive reference is made herein.

By forcing them from the outside with a male fitting, such as e.g. a Luer needleless syringe, the lips 10 open with movements in opposite senses, thus allowing the male fitting to penetrate slit 12, and therefore connector 1, in order to introduce or collect a substance contained in a container attached to the axial extension 5 of the connector.

The connector described and shown in FIG. 1 is to be considered a simple example of male fitting connector to which a male-female adapter according to the present invention can be applied. Other connectors of similar type can be used for the same purpose, for example that described in EP 2 667 839 B1.

A male-female adapter according to the present invention—of which an embodiment indicated as a whole with numeral 21 is shown in FIG. 1—can be coupled to connector 1 or another similar connector for a male fitting.

Adapter 21 comprises an external tubular body 22 with an external side wall 23 provided at one extremity with an axial extension 24 (cylindrical or having two opposite arms) which can be hooked by end folds 25 consisting of projections directed at one another below the collar 4 of connector 1 in a rotatable and axially slidable manner.

Adapter 21 further comprises an internal tubular body 26 which has an axial hole 38 and terminal tangs 27 and 37 which project axially with respect to the extremities of the external tubular body 22.

A middle transversal wall 28 integrally connects a middle portion of the internal tubular body 26 with a corresponding middle portion of the external tubular body 22.

Two threadings 29 and 30 extend in opposite senses along internal portions of said external tubular body 22, which are separated by said middle transversal wall 28. Threading 30 is compatible for screw coupling with the external threading 13 of connector 1.

Figure 2:
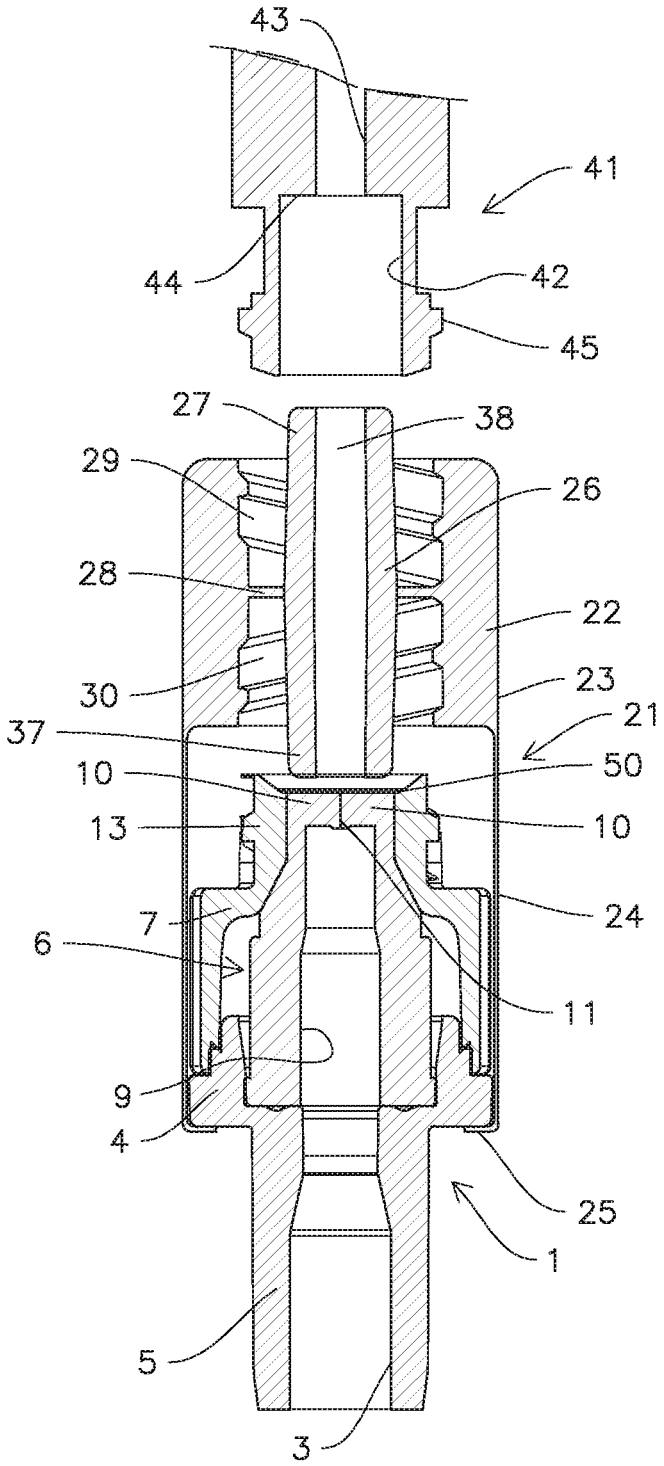
FIG. 2 shows the connector with adapter mounted, ready to receive a female fitting.

FIG. 2 shows connector 1 and adapter 21 hooked to each other, ready to receive a female fitting 41, which shape is vaguely hypothesized by mere way of example in FIG. 2, and comprises, as key parts, a first axial hole 42 having a diameter which is suitable for receiving the terminal tang 27 of adapter 21, a second axial hole 43 having a diameter less than or equal to the internal diameter of the terminal tang 27 of adapter 21, and an internal transversal wall 44 which separates the two holes 42 and 43 and is suitable for resting on the extremity of tang 27. An external threading 45 compatible for screw coupling with the internal threading 29 of adapter 21 is also provided. Hole 43 of the female fitting 41 obviously is in communication with an introduction/collection container.

Figure 3:
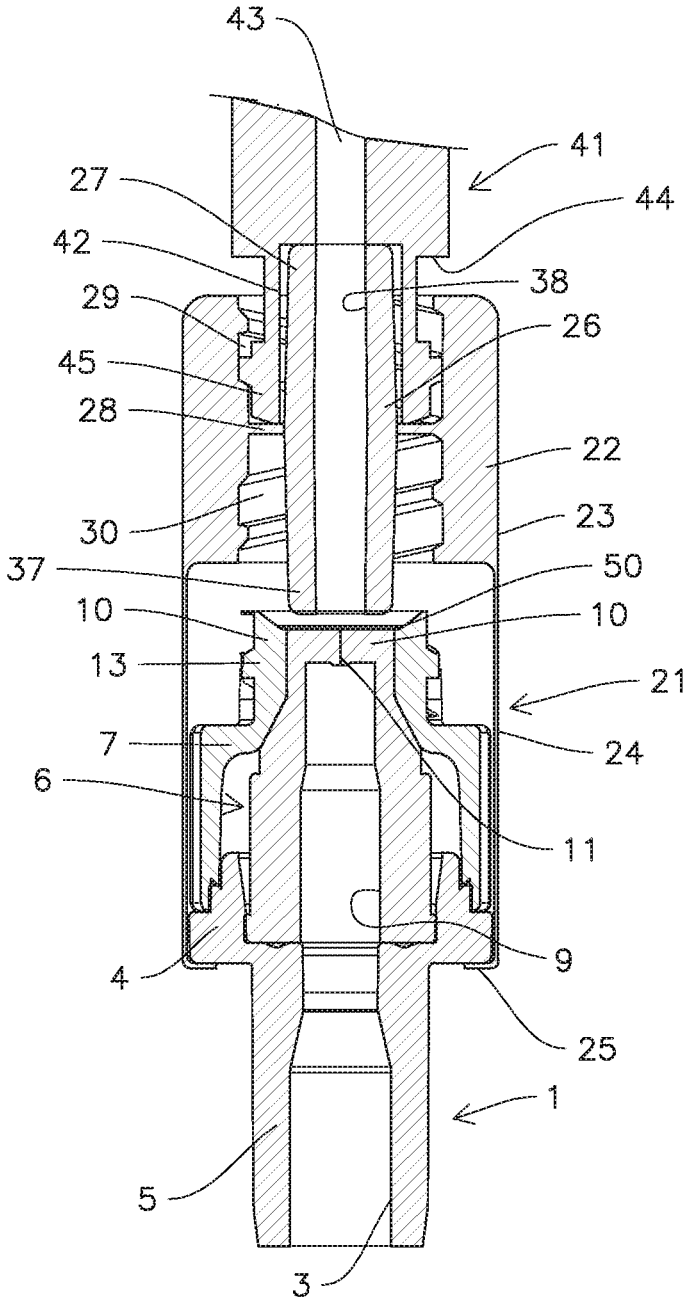
FIG. 3 shows a similar axial section of the connector with female fitting screwed into the upper threaded portion of the adapter.

FIG. 3 shows the female fitting 41 coupled to adapter 21 by screwing the threaded part 45 in the threaded part 29 of adapter 21 with subsequent introduction of the terminal tang 27 in the axial hole 42 of the female fitting 41 up to contact of wall 44 with the extremity of tang 27.

Figure 4:
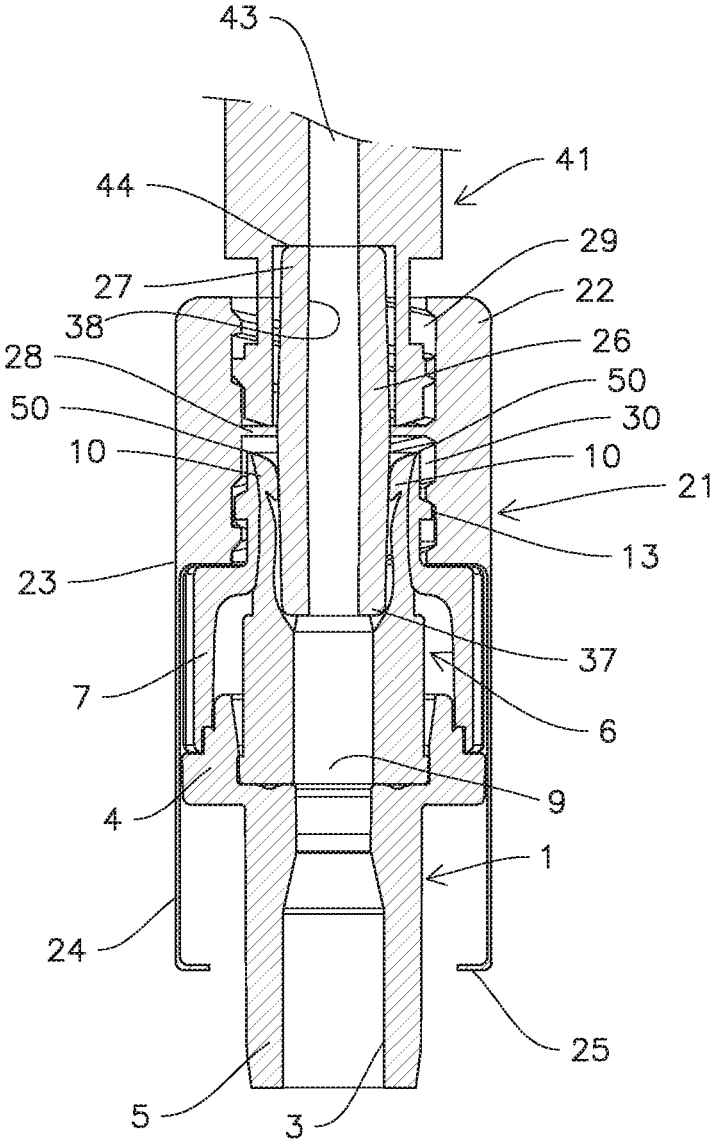
FIG. 4 shows a similar axial section of the connector with adapter and female fitting in open position of the closing plug of the connector.

After such a screwing, the opening of the plug 6 of connector 1 may be performed by axially pushing and rotating adapter 21 so as to screw the threaded part 30 of adapter 21 on the threaded part 13 of connector 1 and by pushing the terminal tang 37 of adapter 21 against membrane 50 and the underlying flexible lips 10 of the closing plug 6 of connector 1 up to causing the temporary breaking of membrane 50 and the mutual distancing of the lips themselves due to the subsequent widening of slit 12 and the introduction of the whole tang 37 in plug 6, with subsequent communication between the holes 3, 9, 38 and 43. Now the operation may be performed of passing the liquid from one of the liquid containers to the other of the liquid containers thus connected to each other. FIG. 4 shows the final position of the various parts with the connector open.

Once the liquid introduction/collection operation is complete, reverse movements of the female fitting 41 cause the return of the various parts 1, 21 and 41 to the original condition in FIG. 2, with subsequent hermetical reclosing of plug 6 due to the elastic properties of the flexible lips 10 and of membrane 50, which having self-sealing properties, closes and seals the slit 12 of plug 6 again.

The invention claimed is:

1. A male-female adapter for a hermetically closable connector provided with an external threading and with a sealing plug which may be bored by a male fitting the adapter containing an external tubular body with an external side wall provided at one extremity with an axial extension which can be hooked to the connector in a rotatable and axially slidable way, an internal tubular body with terminal tangs axially projecting from first and second extremities of said external tubular body, a middle transversal wall which integrally connects a middle portion of said internal tubular body with a corresponding middle portion of said external tubular body and two opposite sense threadings formed in internal portions of said external tubular body which threadings are separated by said middle transversal wall.

2. The adapter according to claim 1, wherein said axial projection is provided with end folds directed towards each other.

3. A connector with hermetic closure for devices intended for collection of liquid solutions for pharmacological and/or nutritional use, comprising an external threading and a closing plug which can be bored by pressure of a male fitting, wherein the closing plug comprises flexible closing lips separated by a slit which can be opened by introducing said male fitting and are elastically sealingly reclosable upon extraction of the previously introduced male fitting, further comprising a male-female adapter comprising an external tubular body with an external side wall provided at one extremity with an axial extension which can be hooked to the connector in a rotatable and axially slidable way, an internal tubular body with terminal tangs axially projecting from respective extremities of said external tubular body, a middle transversal wall which integrally connects a middle portion of said internal tubular body with a corresponding middle portion of said external tubular body and two opposite sense threadings formed in internal portions of said external tubular body which are separate by said middle transversal wall.

4. The connector according to claim 3, wherein said closing plug comprises a sealing membrane which can be bored and elastically hermetically reclosed and is arranged to close hermetically said slit.

5. The connector according to claim 4, wherein said membrane is made in one piece with said closing plug.

6. The connector according to claim 3, wherein said axial extension is provided with end folds directed towards each other.

* * * * *